US011001085B2

(12) United States Patent
Ikushima

(10) Patent No.: US 11,001,085 B2
(45) Date of Patent: May 11, 2021

(54) LIQUID MATERIAL APPLICATION DEVICE AND APPLICATION METHOD

(71) Applicant: MUSASHI ENGINEERING, INC., Mitaka (JP)

(72) Inventor: Kazumasa Ikushima, Mitaka (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 0 days.

(21) Appl. No.: 16/652,824

(22) PCT Filed: Nov. 1, 2018

(86) PCT No.: PCT/JP2018/040765
§ 371 (c)(1),
(2) Date: Apr. 1, 2020

(87) PCT Pub. No.: WO2019/088237
PCT Pub. Date: May 9, 2019

(65) Prior Publication Data

US 2020/0230983 A1 Jul. 23, 2020

(30) Foreign Application Priority Data

Nov. 2, 2017 (JP) ..... JP2017-212998

(51) Int. Cl.
*B41J 25/00* (2006.01)
*B41J 25/304* (2006.01)
(Continued)

(52) U.S. Cl.
CPC ..... *B41J 25/006* (2013.01); *B05C 5/02* (2013.01); *B05C 5/0283* (2013.01);
(Continued)

(58) Field of Classification Search
CPC ..... B41J 25/006; B41J 3/4073; B41J 25/304; B41J 11/20; B05C 13/02; B05C 5/02; B05C 5/0283
See application file for complete search history.

(56) References Cited

U.S. PATENT DOCUMENTS

2010/0156970 A1* 6/2010 Ikushima ..... B05B 12/06 347/8
2010/0255208 A1 10/2010 Hara et al.
(Continued)

FOREIGN PATENT DOCUMENTS

CN 205731824 U 11/2016
CN 206567170 U 10/2017
(Continued)

OTHER PUBLICATIONS

IP.com search (Year: 2021).*
(Continued)

*Primary Examiner* — Lisa Solomon
(74) *Attorney, Agent, or Firm* — Westerman, Hattori, Daniels & Adrian, LLC

(57) ABSTRACT

An application device and an application method are disclosed which enable a three-dimensional applying and drawing process to be performed without provision of any rotary mechanism on a discharge head. The application device comprises a discharge head that includes a discharge device having a discharge port opened in a Z direction, a stage that holds a workpiece, a set of XYZ relatively-moving devices that moves the discharge head and the stage relative to each other, an R-axis rotation device that rotates the stage about an R-axis parallel to an XY plane, a P-axis rotation device that rotates the stage about a P-axis parallel to the XY plane, the P-axis extending in a different direction from the R-axis, a control device, and a stand, wherein the P-axis rotation device is disposed under the R-axis rotation device, and the P-axis rotation device rotates the stage and the R-axis rotation device together.

20 Claims, 16 Drawing Sheets

(51) Int. Cl.

| | |
|---|---|
| ***B41J 11/20*** | (2006.01) |
| ***B41J 3/407*** | (2006.01) |
| ***B05C 5/02*** | (2006.01) |
| ***B05C 13/02*** | (2006.01) |

(52) U.S. Cl.
CPC ..... *B41J 3/4073* (2013.01); *B41J 11/20* (2013.01); *B41J 25/304* (2013.01); *B05C 13/02* (2013.01)

(56) References Cited

U.S. PATENT DOCUMENTS

| | | | |
|---|---|---|---|
| 2016/0306364 | A1 | 10/2016 | Ikushima |
| 2017/0036457 | A1 | 2/2017 | Ikeda et al. |
| 2017/0066005 | A1 | 3/2017 | Ikushima |

FOREIGN PATENT DOCUMENTS

| | | | |
|---|---|---|---|
| JP | 11-8499 | A | 1/1999 |
| JP | 2011-62589 | A | 3/2011 |
| JP | 2012-228660 | A | 11/2012 |
| JP | 2015-145009 | A | 8/2015 |
| JP | 2015-202491 | A | 11/2015 |
| WO | 2009/060884 | A1 | 5/2009 |
| WO | 2012/124253 | A1 | 9/2012 |
| WO | 2015/083722 | A1 | 6/2015 |
| WO | 2015/137271 | A1 | 9/2015 |

OTHER PUBLICATIONS

International Search Report dated Jan. 29, 2019, issued in counterpart International Application No. PCT/JP2018/040765 (2 pages).
Office Action dated Mar. 2, 2021, issued in counterpart CN Application No. 201880071237.5, with English translation (12 pages).

* cited by examiner

[Fig.1]
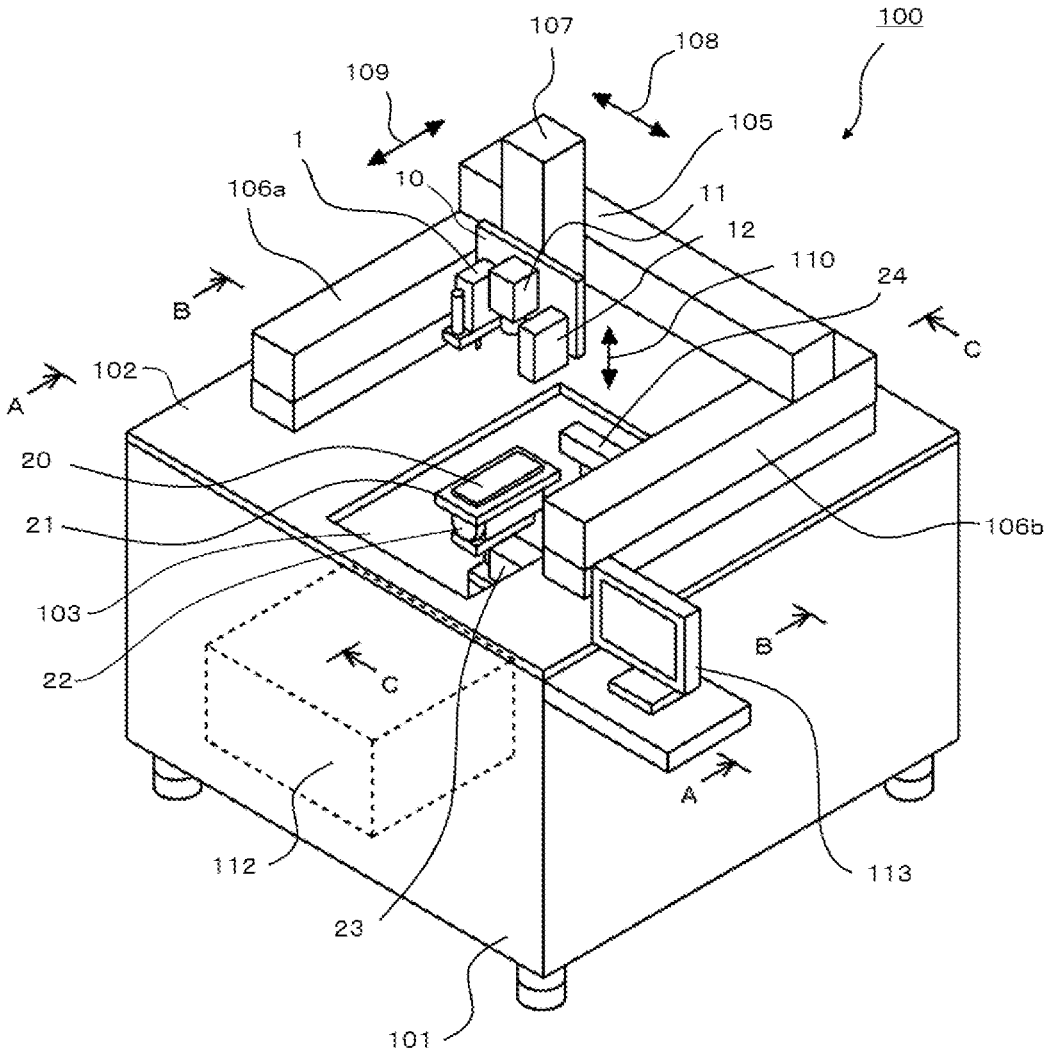

[Fig.2]
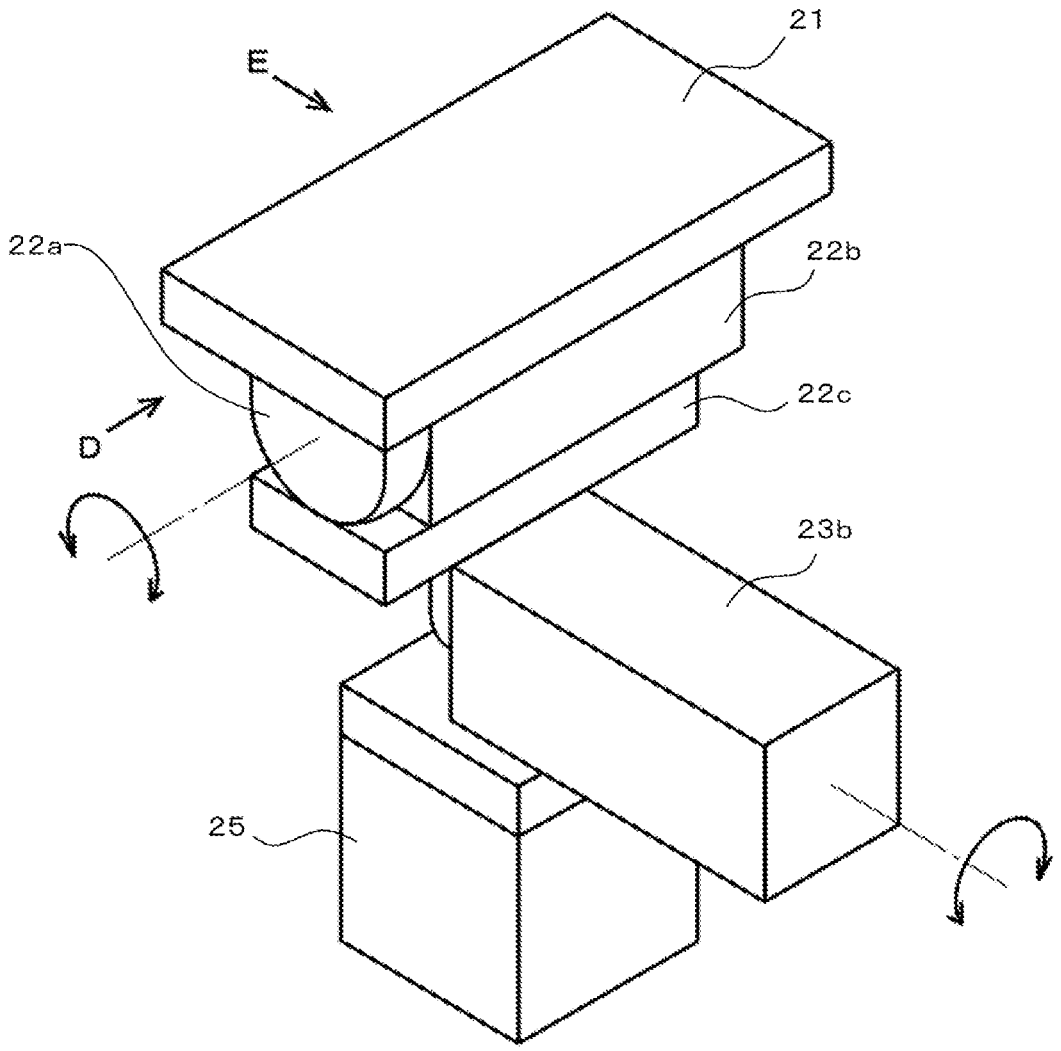

[Fig.3]
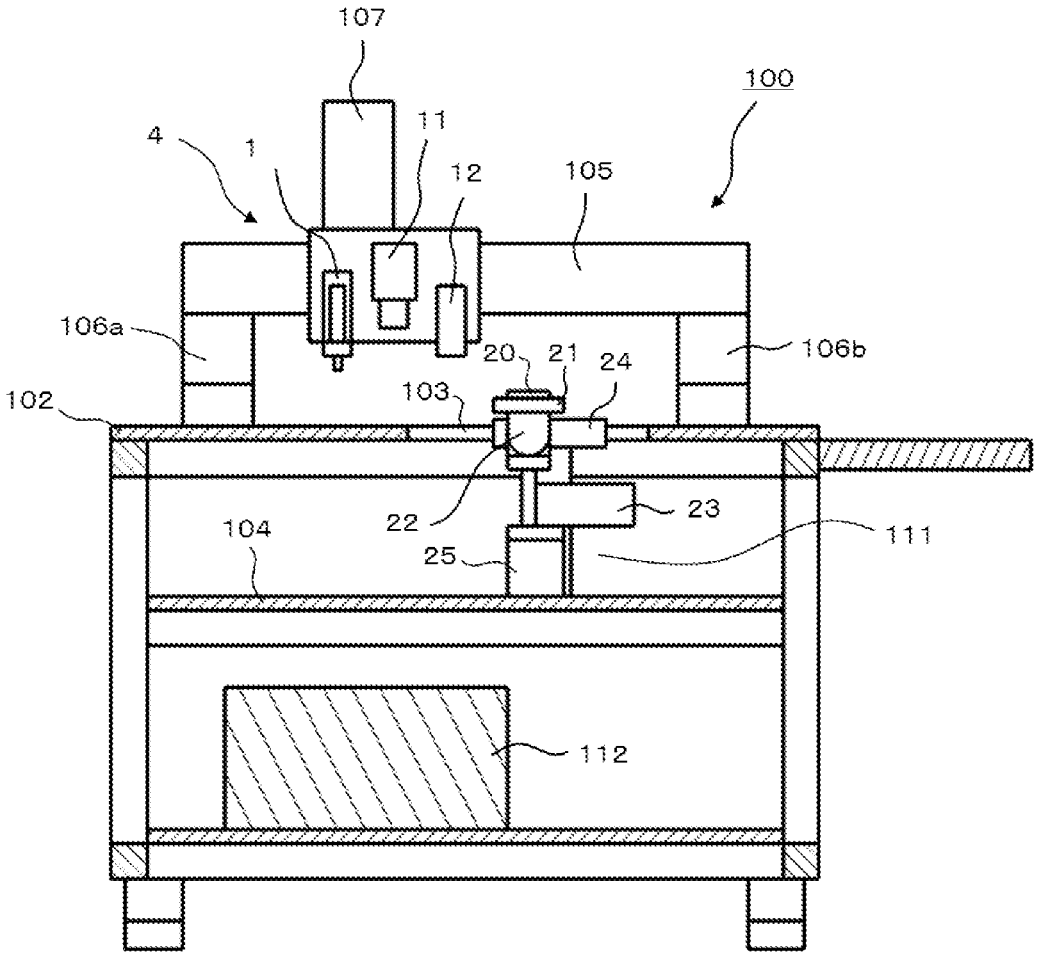

[Fig.4]
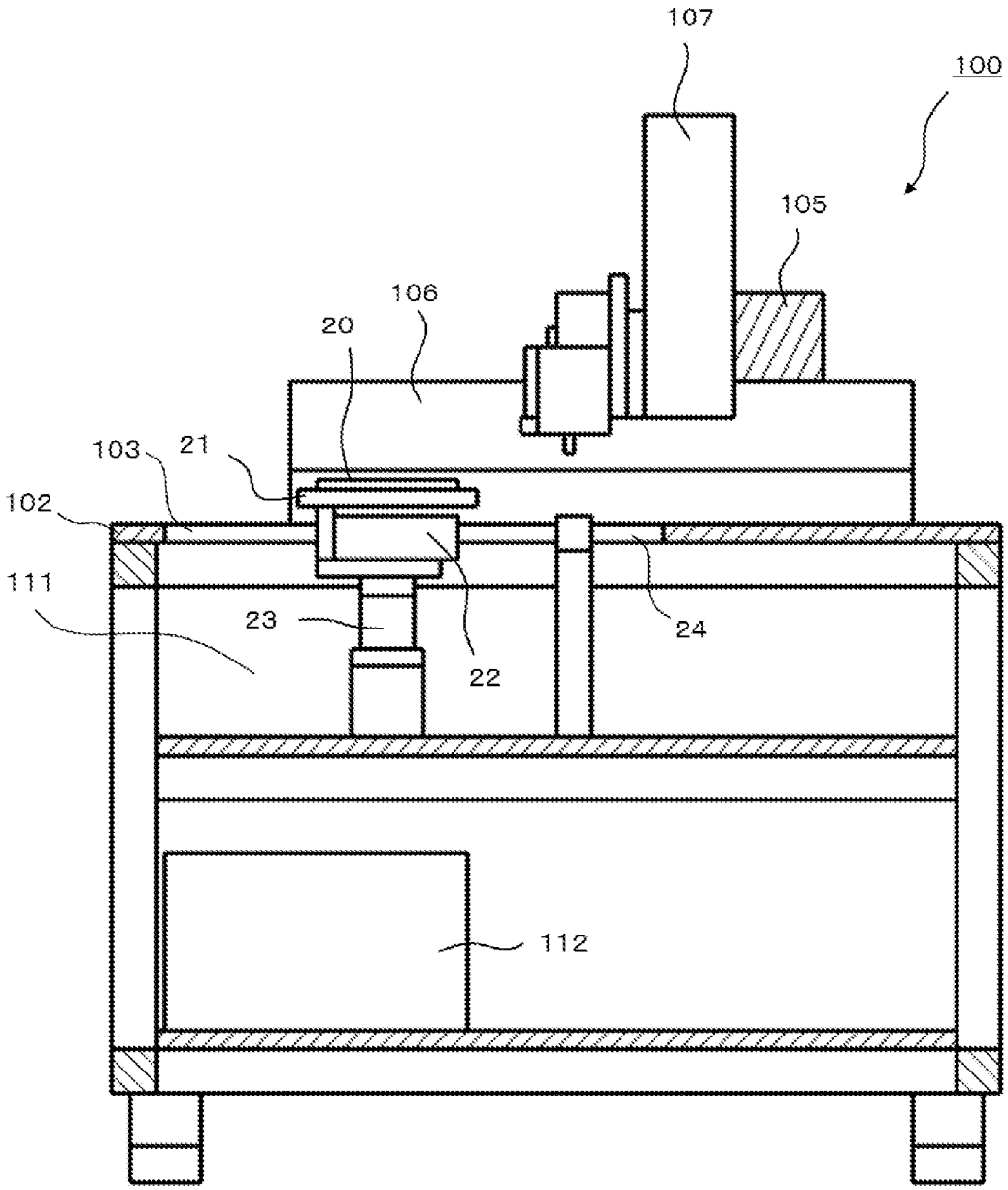

[Fig.5]
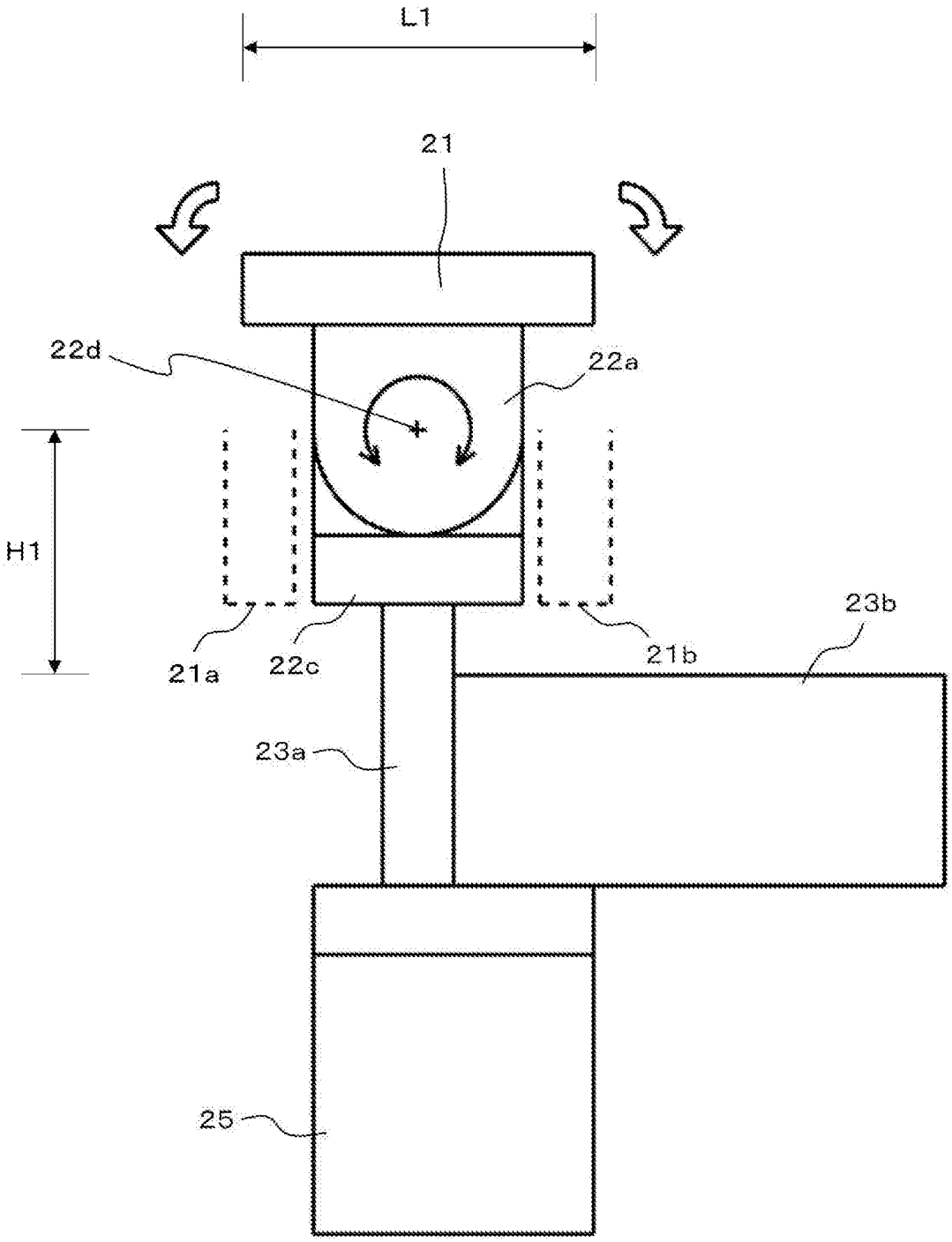

[Fig.6]
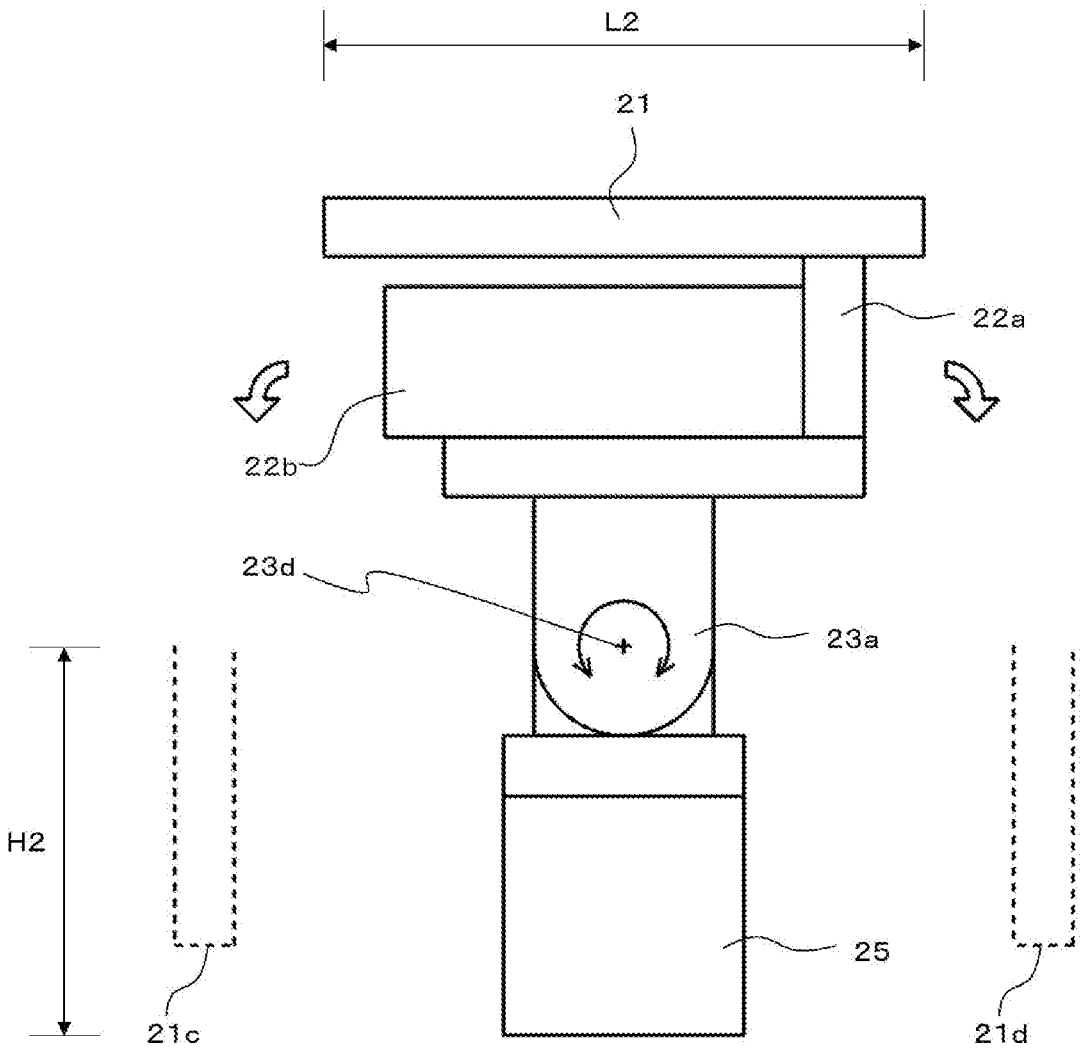

[Fig.7]
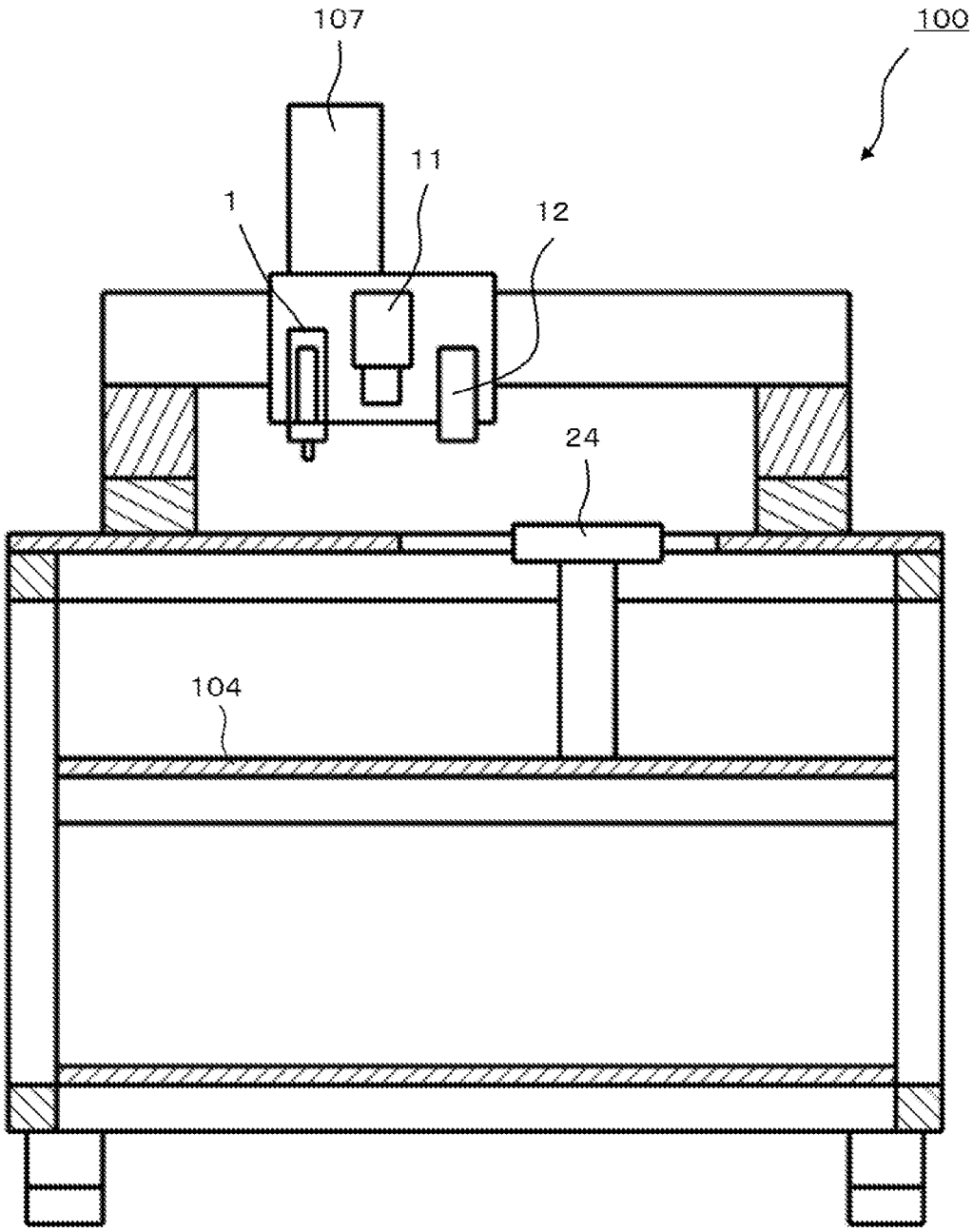

[Fig.8]
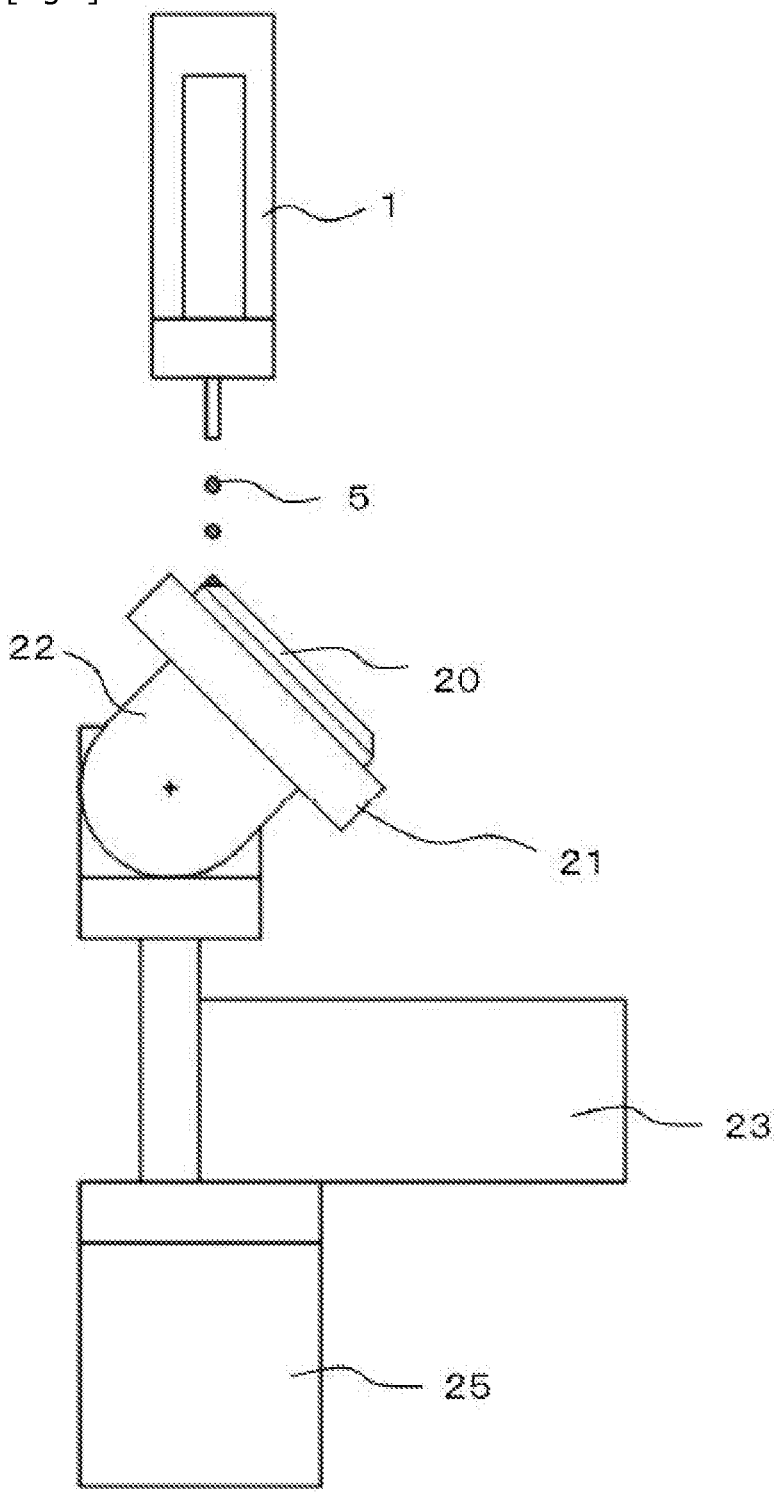
D arrow view

[Fig.9]
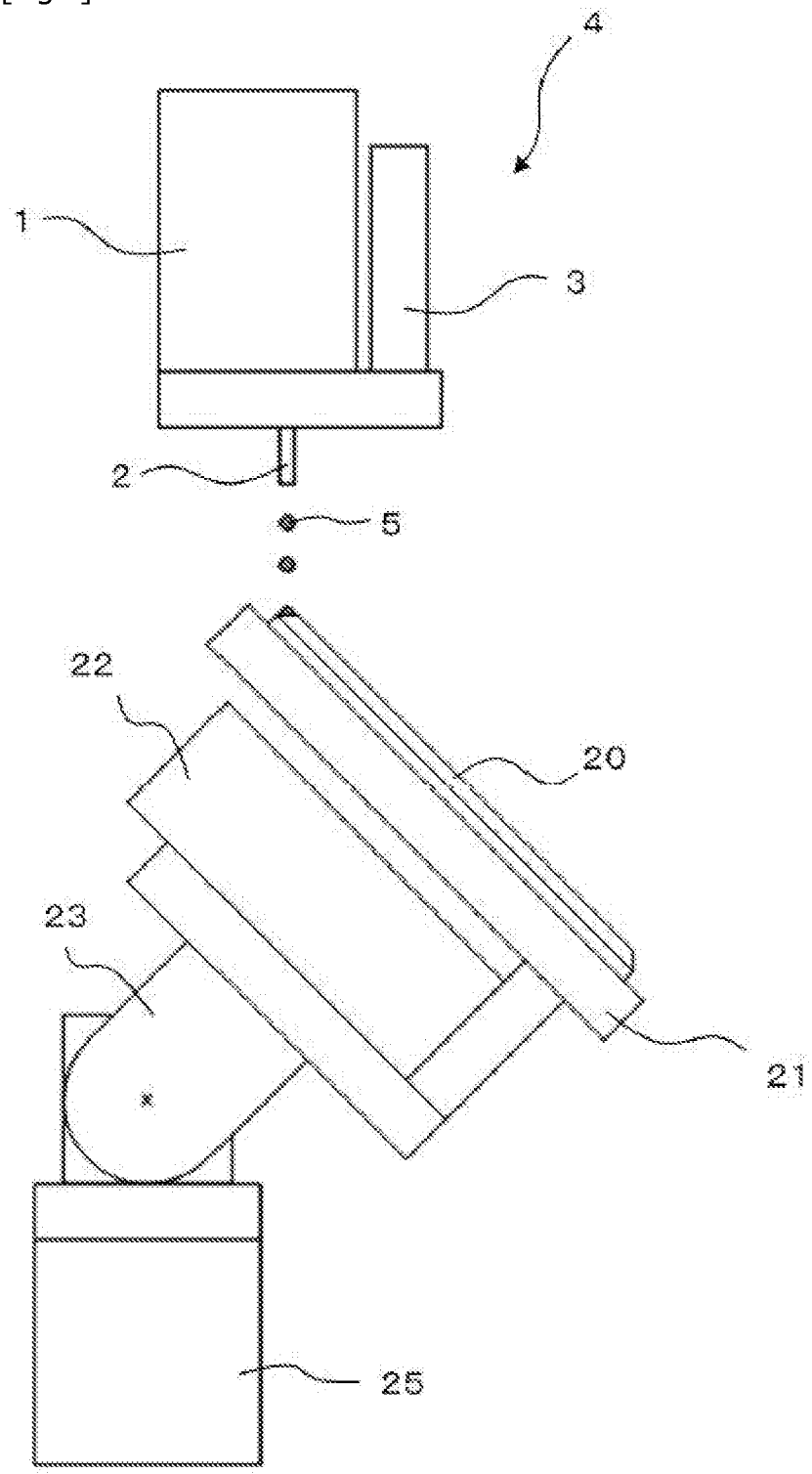
E arrow view

[Fig.10]
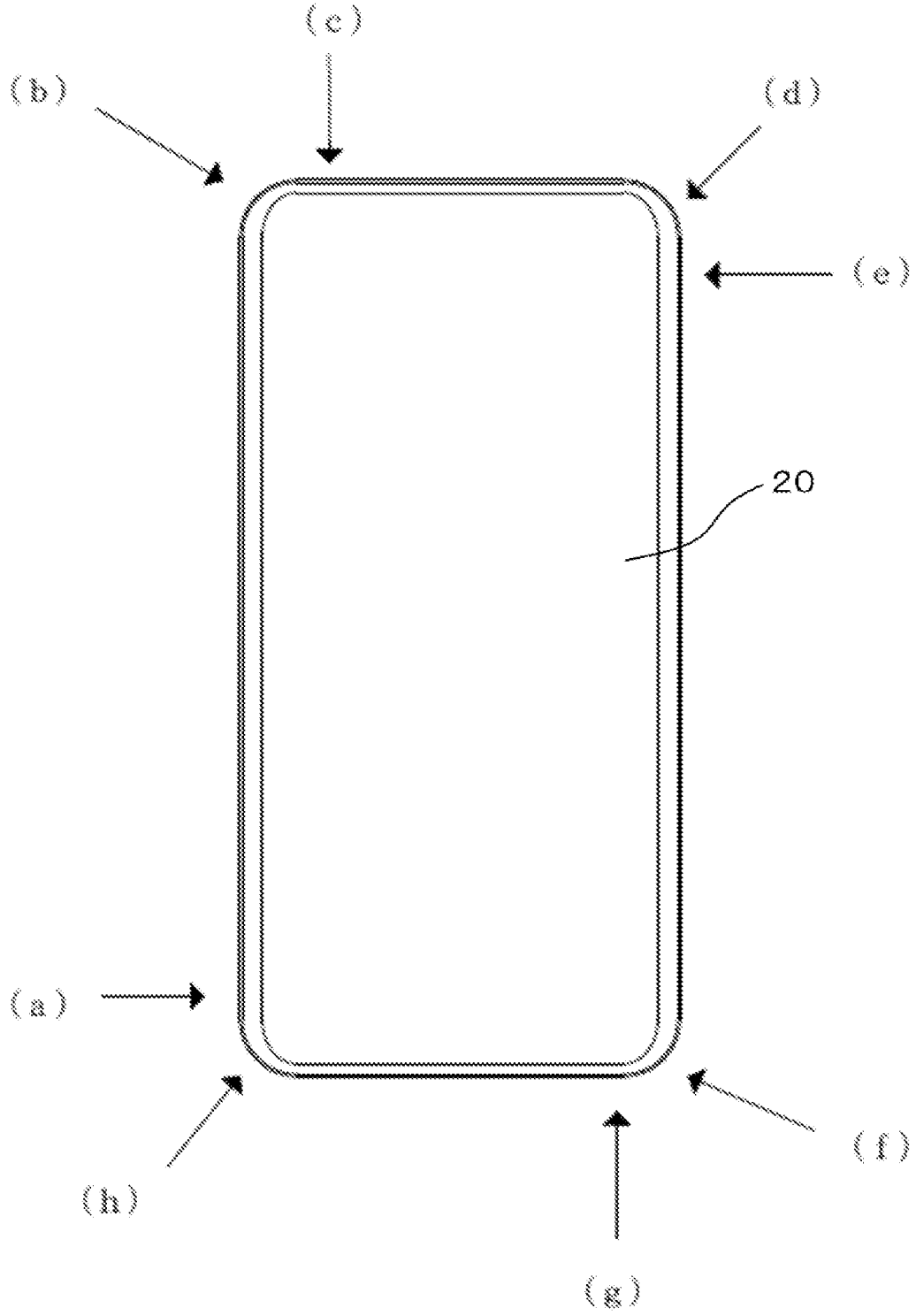

[Fig.11]
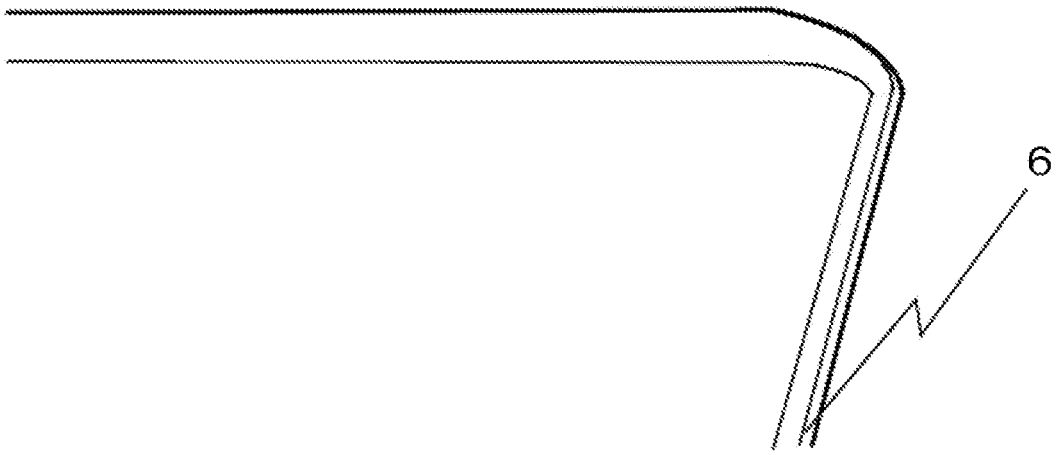

[Fig.12]
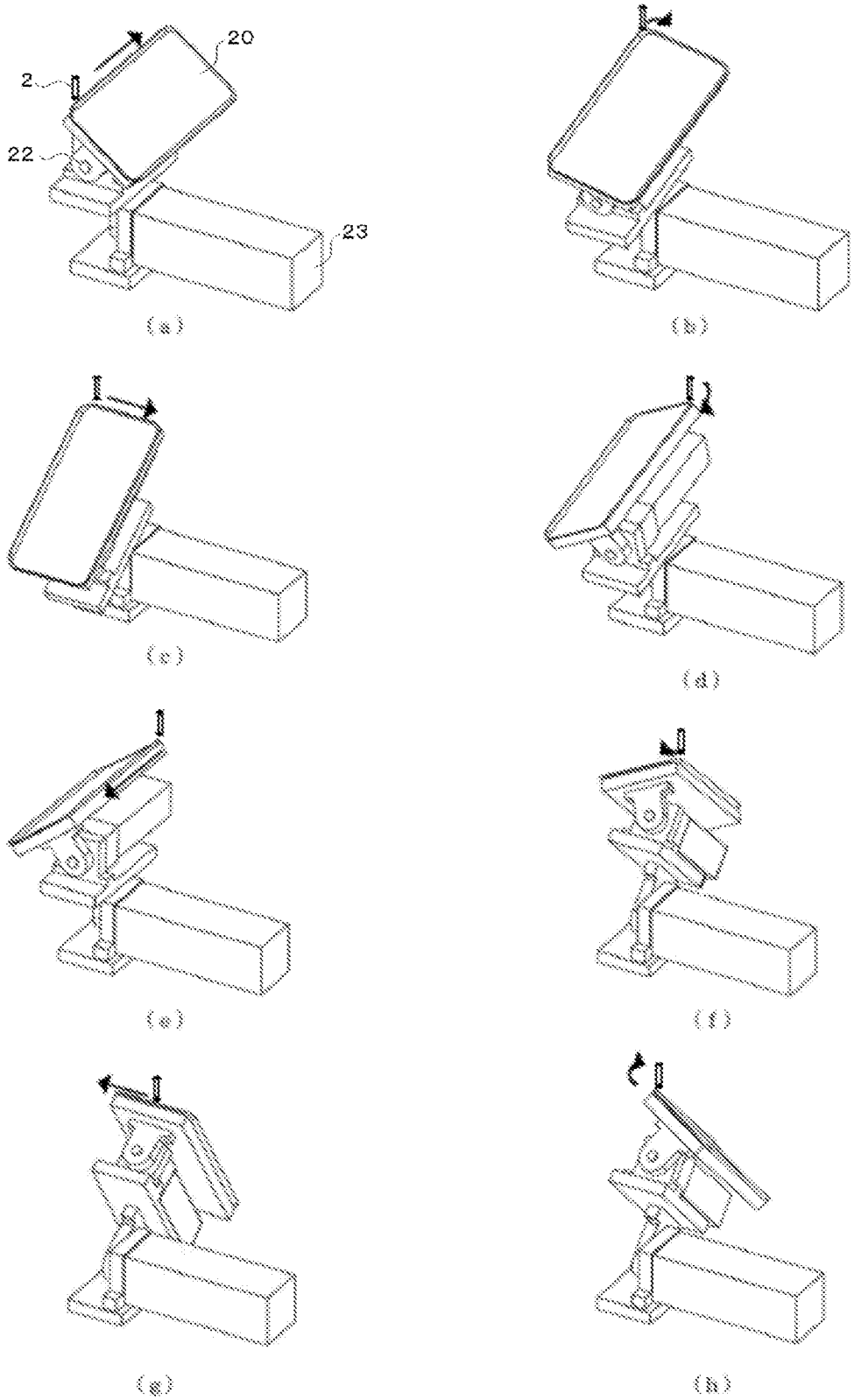

[Fig.13]
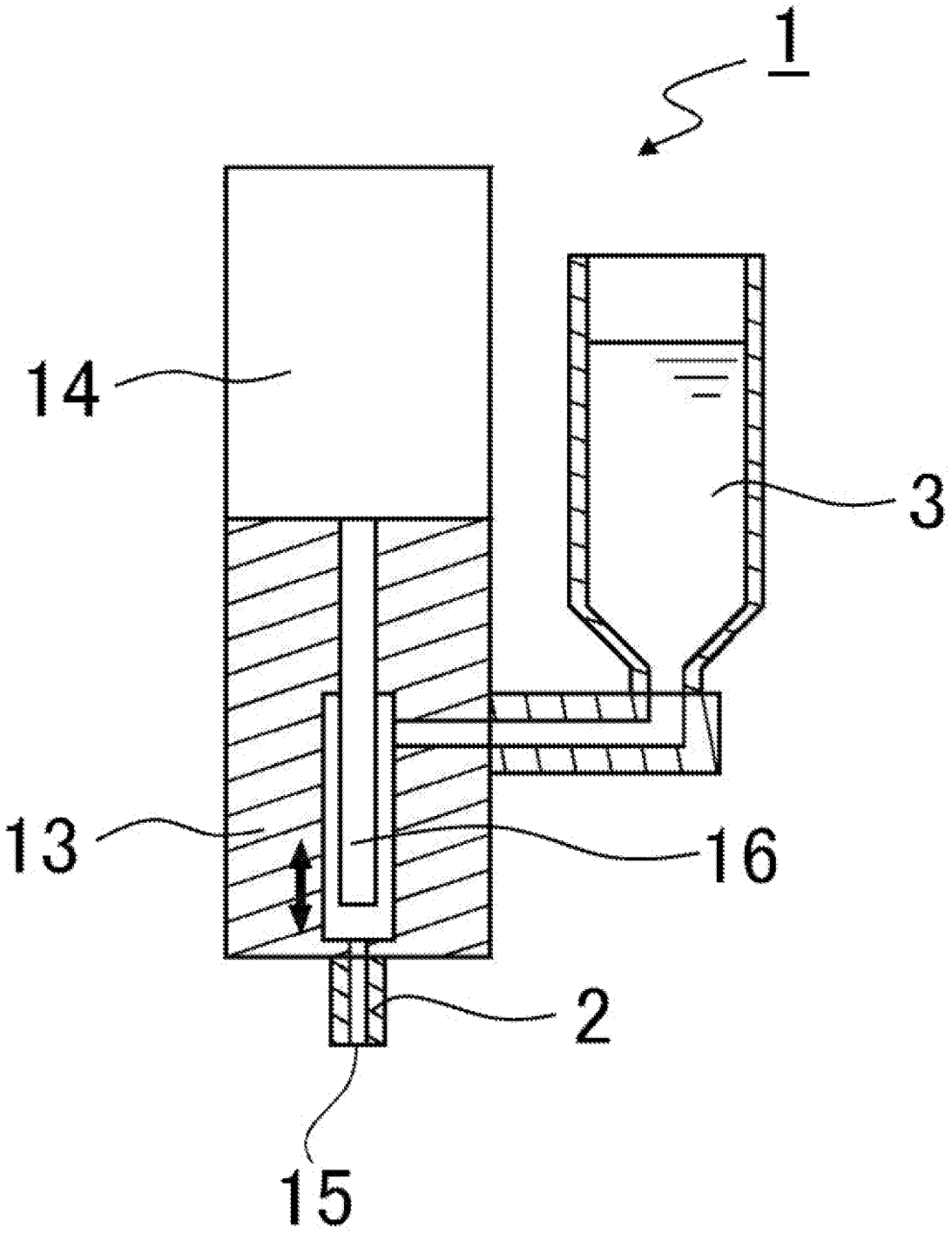

[Fig.14]
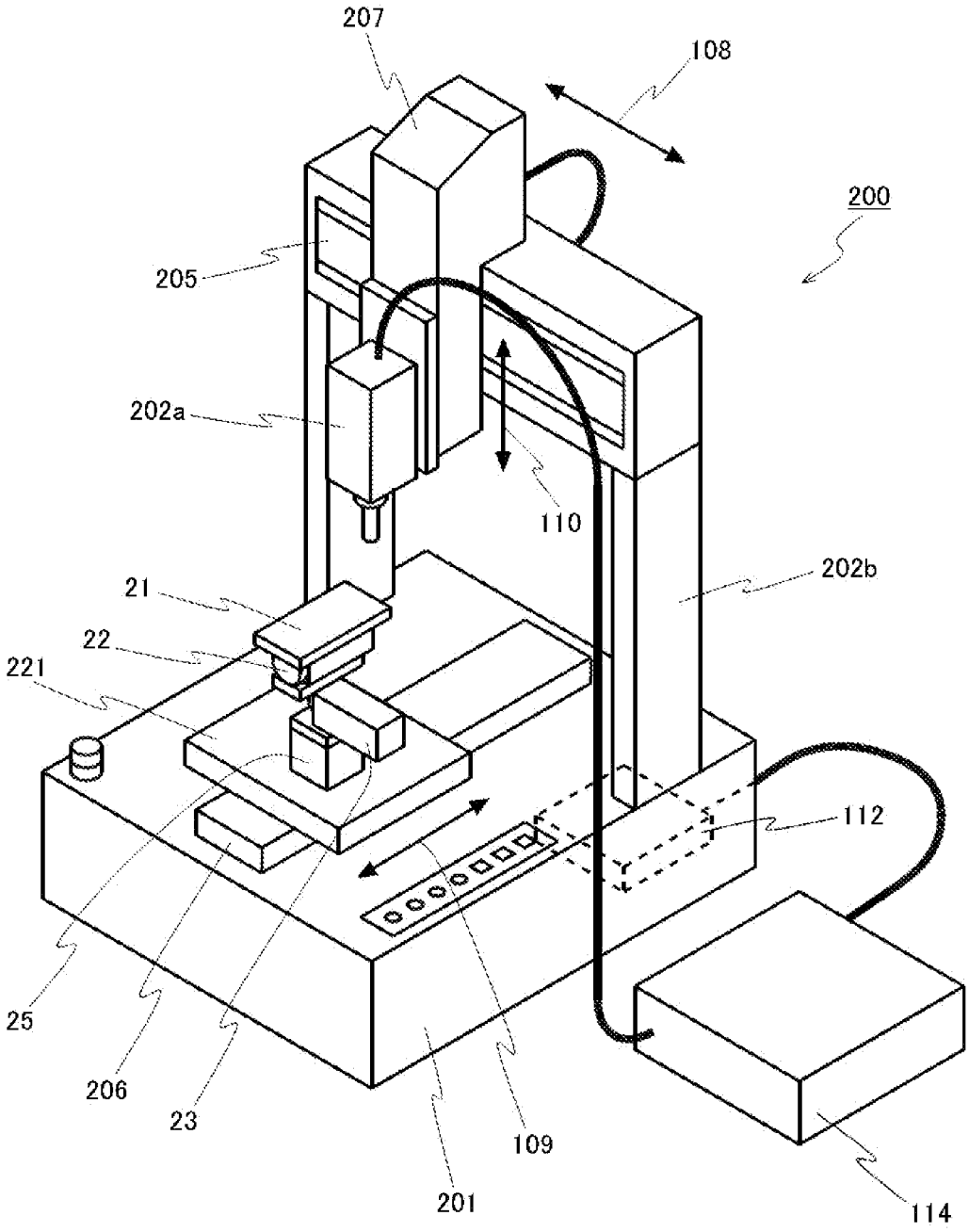

[Fig.15]
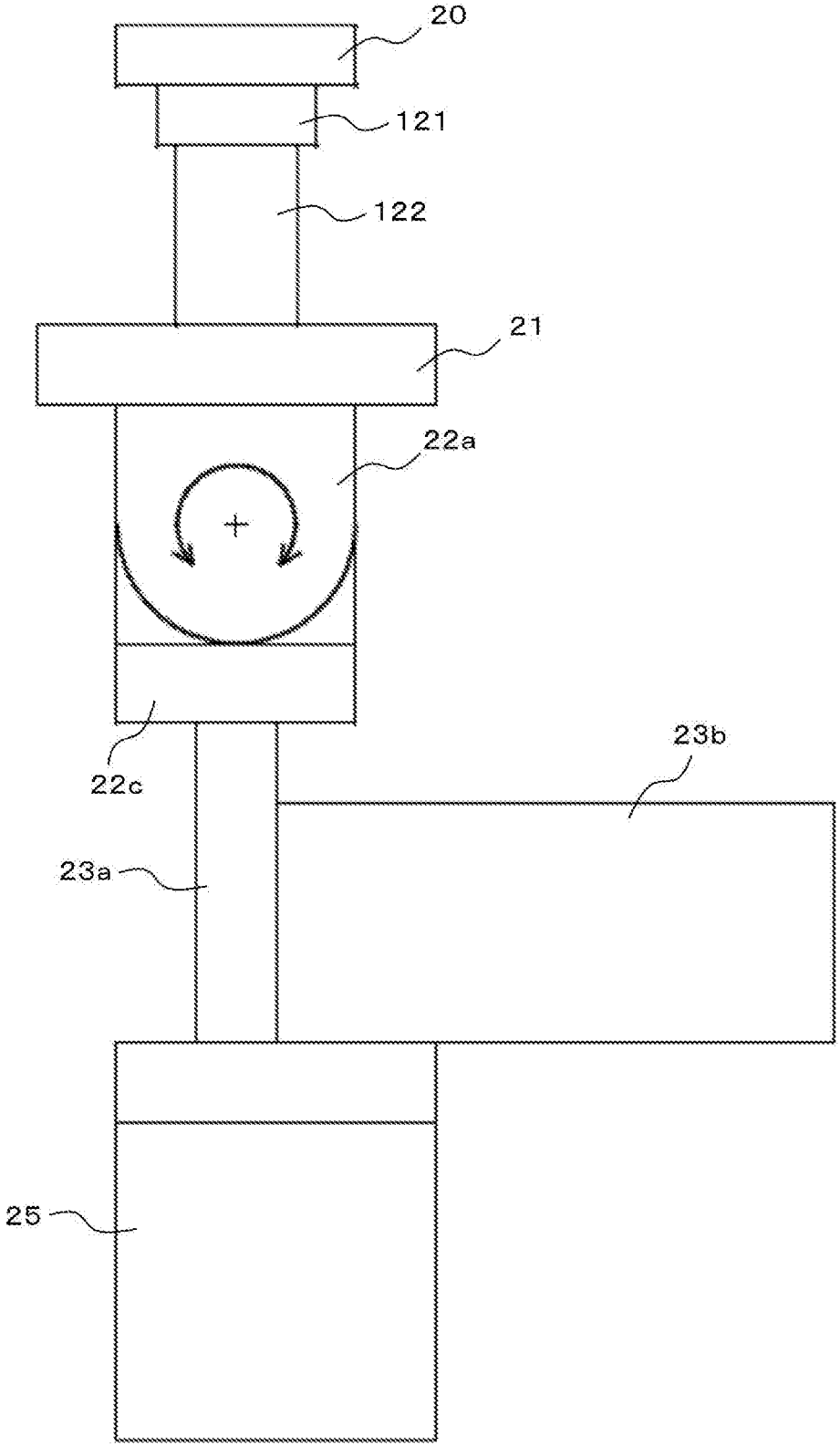

[Fig.16]
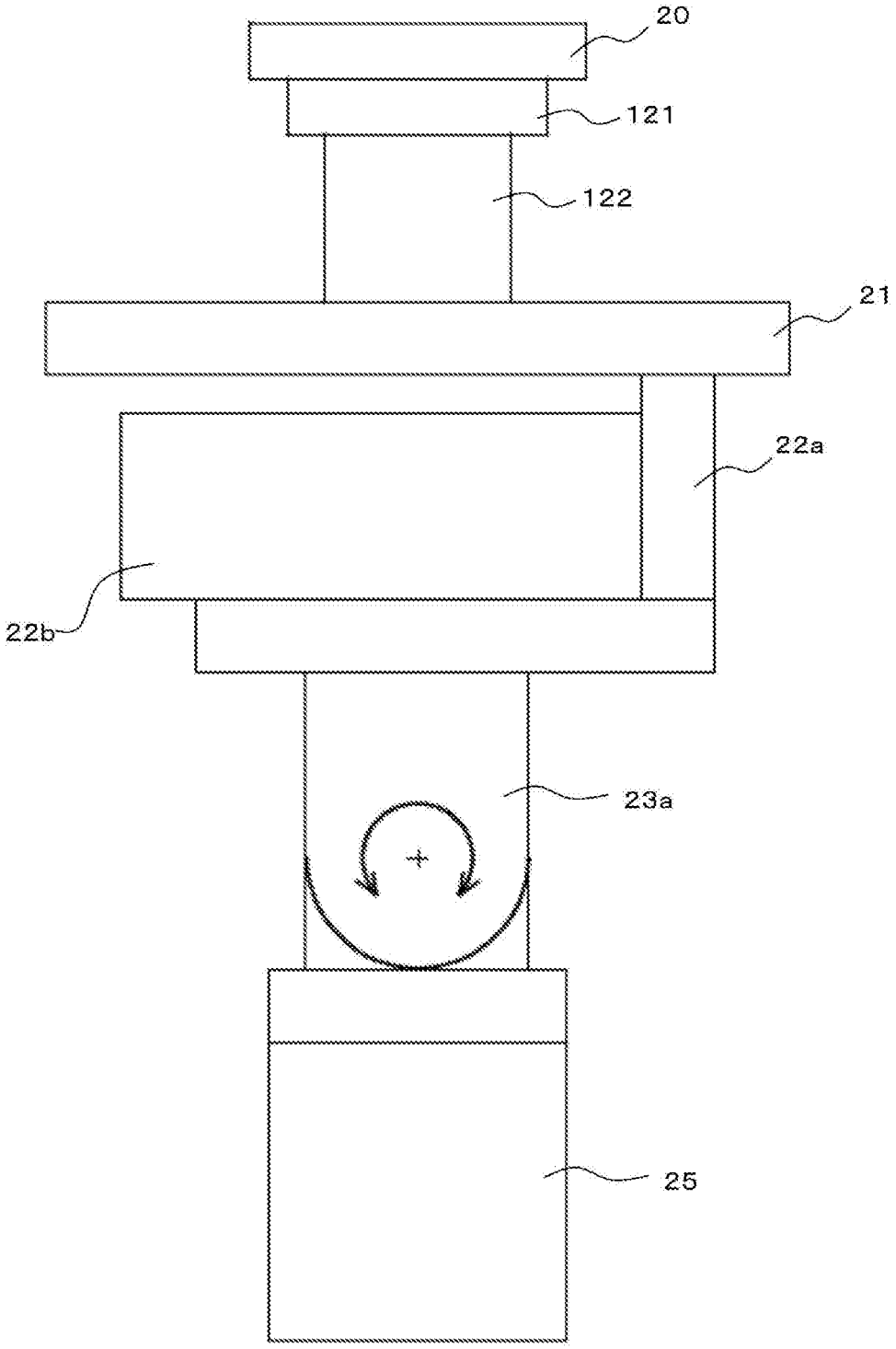

LIQUID MATERIAL APPLICATION DEVICE AND APPLICATION METHOD

TECHNICAL FIELD

The present invention relates to an application device and an application method each enabling application to be performed in a state in which a stage holding an application target thereon is inclined.

BACKGROUND ART

There is known a liquid material application device in which a liquid material is discharged from a nozzle and the discharge liquid material is applied to a workpiece placed on a stage. The need for performing an applying and drawing process on a three-dimensional object has increased in recent years. In particular, techniques for performing the applying and drawing process on a lateral surface of the three-dimensional object have been demanded.

For example, Patent Document 1 discloses a liquid material application device that can simplify, by using an inclinable stage, positioning of a workpiece to which the liquid material is applied.

CITATION LIST

Patent Document

Patent Document 1: Japanese Patent Laid-Open Publication No. H11-8499

SUMMARY OF INVENTION

Technical Problem

For the purpose of realizing high-speed application, it is important to reduce the weight of a discharge head. This point is similarly applied to the case of performing an applying and drawing process on the three-dimensional object. If a rotation mechanism is disposed on the discharge head to perform the three-dimensional applying and drawing process, the weight of the discharge head increases, thus causing a problem that the discharge head cannot move at high speed.

Accordingly, an object of the present invention is to provide an application device and an application method each enabling the three-dimensional applying and drawing process to be performed without provision of any rotation mechanism on a discharge head.

Solution to Problem

The application device according to the present invention comprises a discharge head that includes a discharge device having a discharge port opened in a Z direction, a stage that holds a workpiece, a set of XYZ relatively-moving devices that moves the discharge head and the stage relative to each other, an R-axis rotation device that rotates the stage about an R-axis parallel to an XY plane, a P-axis rotation device that rotates the stage about a P-axis parallel to the XY plane, the P-axis extending in a different direction from the R-axis, a control device, and a stand, wherein the P-axis rotation device is disposed under the R-axis rotation device, and the P-axis rotation device rotates the stage and the R-axis rotation device together. With those features, since the discharge head does not include a rotation mechanism for rotating the discharge device, the weight of the discharge head can be reduced.

In the above application device, the R-axis rotation device may be able to rotate the stage through an angle of not smaller than ±60°, and the P-axis rotation device may be able to rotate the stage through an angle of not smaller than ±60°.

In the above application device, the R-axis rotation device may be able to rotate the stage through an angle of ±90°, and the P-axis rotation device may be able to rotate the stage through an angle of ±90°. Here, the expression "the rotation through an angle of ±90°" includes the case of rotating the stage through an angle of larger than ±90°.

In the above application device, the application device may not include a rotation mechanism that rotates the stage in a θ direction.

In the above application device, a maximum width L1 of the stage in a direction perpendicular to the R-axis may be shorter than a maximum width L2 of the stage in a direction perpendicular to the P-axis.

In the above application device, a height H1 from an upper end of a member, the member positioned under a lateral side of the stage when the R-axis rotation device is operated, to the R-rotation axis may be set to a distance that is not shorter than a half of the maximum width L1, and a height H2 from an upper end of a member, the member positioned under a lateral side of the stage when the P-axis rotation device is operated, to the P-rotation axis is set to a distance that is not shorter than a half of the maximum width L2.

In the above application device, the stand may include a top plate having an opening that is formed to extend over a movable region of the stage, and a stage movable space in which the stage is allowed to rotate about the R-axis and the P-axis. Furthermore, the set of XYZ relatively-moving devices may be disposed on the top plate.

In the above application device, the set of XYZ relatively-moving devices may be constituted by two first-direction moving devices that are disposed with the stage interposed therebetween, a second-direction moving device that is mounted a bridging relation to the two first-direction moving devices, and a third-direction moving device that is mounted to the second-direction moving device.

The above application device may further comprise a plurality of posts extending upward from the stand, and a table installed on the stand, wherein the R-axis rotation device and the P-axis rotation device may be installed on the table, and the set of XYZ relatively-moving devices may be constituted by a first-direction moving device that moves the table in a first direction, a second-direction moving devices that is supported by the plurality of posts, and a third-direction moving device that is mounted to the second-direction moving device.

In the above application device, the discharge head may be mounted to the third-direction moving device and may not include a rotation mechanism rotating the discharge device.

In the above application device, the stage may be prepared as a plurality of stages having different areas, and application work may be performed by using one selected from the plurality of stages and holding a workpiece on the selected one stage.

In the above application device, the discharge device may be a discharge device of jet type moving a valve member forward, stopping the valve member to apply inertial force to a liquid material, and discharging the liquid material in a flying form.

In the above application device, the set of XYZ relatively-moving devices may be constituted by an X direction moving device that moves the discharge head and the stage relative to each other along a linear line in an X direction, a Y direction moving device that moves the discharge head and the stage relative to each other along a linear line in a Y direction, and a Z direction moving device that moves the discharge head and the stage relative to each other along a linear line in a Z direction, and when a linear or curved application line is formed, the control device may move at least one of the X direction moving device and the Y direction moving device such that the discharge head continuously performs relatively-moving operation.

The application method according to a first aspect of the present invention is an application method of performing application on a workpiece placed on a stage with the above application device.

The application method according to a second aspect of the present invention is an application method of performing application on a workpiece placed on a stage with the above application device, the application method comprising a first-lateral-surface application step of performing the application on a first lateral surface of the workpiece in a state in which, after rotating the stage by the R-axis rotation device, the R-axis rotation device and the P-axis rotation device are both stopped and a clearance between the discharge device and the workpiece is kept constant; and a second-lateral-surface application step of performing the application on a second lateral surface of the workpiece, the second lateral surface intersecting the first lateral surface, in a state in which, after rotating the stage by the P-axis rotation device, the R-axis rotation device and the P-axis rotation device are both stopped and the clearance between the discharge device and the workpiece is kept constant, wherein the second-lateral-surface application step is performed after performing the first-lateral-surface application step, or the first-lateral-surface application step is performed after performing the second-lateral-surface application step.

The application method according to the second aspect may further comprise a corner application step performed after performing the first-lateral-surface application step and before performing the second-lateral-surface application step, or after performing the second-lateral-surface application step and before performing the first-lateral-surface application step, wherein, in the corner application step, the application may be performed on a rounded corner portion, which is continuous with the first lateral surface or the second lateral surface of the workpiece, by continuously operating the R-axis rotation device and the P-axis rotation device while the clearance between the discharge device and the workpiece is kept constant.

In the application methods according to the first and second aspects, the workpiece may have a size enough to cover the stage.

Advantageous Effect of Invention

According to the present invention, the application device and the application method can be provided which enable the three-dimensional applying and drawing process to be performed without provision of any rotation mechanism on a discharge head.

BRIEF DESCRIPTION OF THE DRAWINGS

FIG. 1 is a perspective view of an application device according to a first embodiment.

FIG. 2 is a perspective view of an R-axis rotation device and a P-axis rotation device according to the first embodiment.

FIG. 3 is a sectional view taken along A-A in FIG. 1.

FIG. 4 is a sectional view taken along C-C in FIG. 1.

FIG. 5 is an explanatory view referenced to explain an operation of the R-axis rotation device according to the first embodiment.

FIG. 6 is an explanatory view referenced to explain an operation of the P-axis rotation device according to the first embodiment.

FIG. 7 is a sectional view taken along B-B in FIG. 1.

FIG. 8 is an explanatory view referenced to explain an application operation performed in a state in which a stage is inclined by the R-axis rotation device (when viewed from a direction denoted by an arrow D in FIG. 2).

FIG. 9 is an explanatory view referenced to explain an application operation performed in a state in which the stage is inclined by the P-axis rotation device (when viewed from a direction denoted by an arrow E in FIG. 2).

FIG. 10 is an explanatory view referenced to explain locations in a cover of a smartphone where application work is performed.

FIG. 11 is an enlarged view referenced to explain an application region in FIG. 10.

FIG. 12 is an explanatory view referenced to explain procedures of the application work performed on the cover of the smartphone.

FIG. 13 is a partly-sectioned side view of a jet discharge device that can be mounted to the application device according to the first embodiment.

FIG. 14 is a perspective view of an application device according to a second embodiment.

FIG. 15 is an explanatory view referenced to explain an application device according to a third embodiment.

FIG. 16 is an explanatory view referenced to explain the application device according to the third embodiment.

DESCRIPTION OF EMBODIMENTS

Embodiments for carrying out the present invention will be described below.

First Embodiment

As illustrated in FIG. 1, an application device 100 according to the first embodiment is mainly constituted by a discharge device 1 for discharging a liquid material, a stage 21 on an upper surface of which an application target (workpiece) 20 are placed, an R-axis rotation device 22 for rotating the stage 21 about an R-axis, a P-axis rotation device 23 for rotating the stage 21 about a P-axis, a set of XYZ relatively-moving devices (105, 106 and 107) for moving the discharge device 1 and the stage 21 relative to each other, and a control device 112 for controlling operations of the individual devices.

The stage 21 is a flat plate member having a flat upper surface on which the application target 20 is placed, and it includes a fixing mechanism for fixing the application target (workpiece 20) to the stage 21. The fixing mechanism may be, for example, a mechanism including a plurality of holes formed to establish communication from the inside of the stage 21 to the upper surface, and attracting the application target 20 to be fixed in place by sucking air through the holes, or a mechanism that fixes the application target 20 by sandwiching the application target 20 between fixing members, and by fixing those members to the stage 21 with use of fixing means such as screws. The stage 21 has a short side having a length L1 in an X direction (see FIG. 5), and a long side having a length L2 in a Y direction (see FIG. 6). An area of the workpiece mounted on the stage 21 is preferably larger than that of the stage 21, and more preferably the area has a size enough to cover the entire surface of the stage 21 when viewed from above. By constituting the stage 21 to be smaller than the workpiece, the discharge device 1 can be avoided from interfering with the stage 21 when application is performed on a lateral surface of the workpiece while the stage 21 is inclined. The shape of the stage 21 is not limited to a rectangular shape, and it may be a square, polygonal, or circular shape, for example.

The set of XYZ relatively-moving devices is constituted by an X direction drive device 105, a Y direction drive device 106, and a Z direction drive device 107 that are disposed on a stand 101. In this embodiment, the discharge device 1 is linearly moved relative to the stage 21 in each of the X direction (denoted by 108), the Y direction (denoted by 109), and a Z direction (denoted by 110). In other words, the XYZ relatively-moving devices are constituted so as to move a nozzle 2 of the discharge device 1 and the workpiece on the stage 21 relative to each other in combination of linear movement in the X direction, linear movement in the Y direction, and linear movement in the Z direction. The X direction drive device 105 is mounted in arrangement of bridging two Y direction drive devices 106*a* and 106*b*, and the Z direction drive device 107 is mounted on the X direction drive device 105. The XYZ relatively-moving devices (105, 106 and 107) can be each constituted by combination of an electric motor (such as a servo motor or a stepping motor) and a ball screw, or by a linear motor. Alternatively, the Z direction drive device 107 may be disposed between both of the R-axis rotation device 22 and the P-axis rotation device 23 and a support plate 104.

The control device 112 includes a processing unit and a storage unit both not illustrated. The control device 112 is connected to the discharge device 1, the R-axis rotation device 22, the P-axis rotation device 23, and the XYZ relatively-moving devices (105, 106 and 107), and controls operations of those devices. For example, a personal computer (PC), a programmable logic controller (PLC), or the like can be used as the processing unit and the storage unit. An illustrated touch panel or another device, such as a keyboard or a mouse, can be used as an input/output device 113 capable of performing two-way communication with the control device 112. An application program for implementing an application method according to the present invention is stored in the storage unit of the control device 112.

The discharge device 1 according to the first embodiment may be of discharge type in which the liquid material comes into contact with the workpiece before departing from a discharge port, or another discharge type in which the liquid material comes into contact with the workpiece after departing from the discharge port.

As examples of the discharge type in which the liquid material comes into contact with the workpiece before departing from the discharge port, there are an air type applying, for a desired time, air under regulated pressure to the liquid material in a syringe that has a nozzle disposed at a tip end, a tubing type including a flat tubing mechanism or a rotary tubing mechanism, a plunger type discharging the liquid material by moving, through a desired distance, a plunger to slide while keeping close contact with an inner surface of a storage container that has a nozzle at a tip end, a screw type discharging the liquid material with rotation of a screw, and a valve type controlling the liquid material under desired pressure to be discharged with opening/closing of a valve.

As examples of the discharge type in which the liquid material comes into contact with the workpiece after departing from the discharge port, there are a jet type moving a plunger (valve member) forward and abruptly stopping the plunger to apply inertial force to the liquid material, thus discharging the liquid material in a flying form from a tip end of a nozzle, and an ink jet type operating in a continuous jet mode or a demand mode.

The discharge device 1 is mounted to a base plate 10 together with an image capturing device 11 and a distance measuring device 12. In other words, when the discharge device 1 is moved relative to the application target 20 by the XYZ relatively-moving devices, the image capturing device 11 and the distance measuring device 12 are also moved relative to the application target 20 integrally with the discharge device 1. The devices (1, 11 and 12) mounted to the base plate 10 constitute a discharge head 4. Because the discharge head 4 does not include rotation mechanisms for rotating the devices (1, 11 and 12), the discharge head 4 is lighter than a discharge head including those rotation mechanisms.

FIG. 13 is a partly-sectioned side view of the jet discharge device 1 that can be mounted to the application device 100 according to the first embodiment. The discharge device 1 includes the nozzle 2, a liquid storage container 3, a discharge unit 13, and a discharge driver 14.

The discharge device 1 further includes a plunger 16 that is disposed in a liquid chamber of the discharge unit 13, the liquid chamber communicating with a discharge port 15 of the nozzle 2, and that does not contact with a sidewall of the liquid chamber, or partly contact with the sidewall, but does not impede flow of the liquid material. By moving the plunger 16 forward and backward at high speed, inertial force is applied to the liquid material, whereupon the liquid material can be discharged to fly in the form of a droplet from the discharge port 15 of the nozzle 2.

The discharge port 15 of the nozzle 2 is opened in the Z direction (vertical direction). In other words, the discharge port 15 of the nozzle 2 has an end surface parallel to an XY plane (see FIG. 13). The nozzle 2 is preferably formed of a straight pipe of which center line extends in the Z direction (vertical direction).

Because application work is performed with a certain distance kept between the discharge port 15 of the nozzle 2 and the workpiece (namely, because the liquid material is discharged to fly in the form of a droplet), the jet discharge device 1 has allowance to a deviation of the distance between the discharge port 15 and the workpiece, the deviation being caused by rotation operations about the R-axis and the P-axis. Furthermore, because the application work is performed with the certain distance kept between the nozzle 2 and the workpiece, the rotation operations about the R-axis and the P-axis can be performed without raising the nozzle 2. In another type of discharge device, the operations of the XYZ relatively-moving devices are stopped when the liquid material is applied in the form of a dot. On the other hand, the jet discharge device 1 performs application of successive points while one of the X direction drive device 105 and the Y direction drive device 106 is continuously operated, and hence it has higher productivity.

The image capturing device 11 is a digital camera such as a CCD camera. Teaching work to designate an application position can be performed while viewing an image of the application target 20 captured by the image capturing device 11.

The distance measuring device 12 is a contactless measuring device, such as a laser displacement sensor, which emits a laser beam to the workpiece and measures a distance up to a surface of the workpiece. Alternatively, a contact measuring device brought into contact with the workpiece surface and measuring the distance up to the workpiece surface may be used instead.

The stand 101 has a top plate 102 in which an opening 103 is formed. The opening 103 has a size enough to ensure a movable region of the stage 21. The stage 21, the R-axis rotation device 22, the P-axis rotation device 23, and a utility unit 24 are disposed in the opening 103. Under the opening 103 of the top plate 102, a stage movable space 111 is defined to allow the stage 21 to be rotated therein with the R-axis and the P-axis being rotation centers. On condition that the stage movable space 111 can be secured, just a support member for supporting the Y direction drive device 106 may be disposed without disposing the top plate 102. In addition, a cover with a door may be disposed to cover a space above the top plate 102 of the stand 101.

The R-axis rotation device 22 enables the stage 21 to be rotated about the R-axis parallel to the Y moving direction 109. In other words, the R-axis rotation device 22 can incline the stage 21 to the left and right (in a first direction) about the R-axis. As illustrated in FIG. 2, the R-axis rotation device 22 includes an R-axis rotating body 22*a* rotating about the R-axis, an R-axis turning device (R-axis drive source) 22*b* constituted by an electric motor or the like, and a base plate 22*c*.

The P-axis rotation device 23 enables the stage 21 to be rotated about the P-axis perpendicular to the R-axis. In other words, the P-axis rotation device 23 can incline the stage 21 back and forth (in a second direction perpendicular to the first direction) about the P-axis. The P-axis rotation device 23 includes a P-axis rotating body 23*a* rotating about the P-axis and a P-axis turning device (P-axis drive source) 23*b* constituted by an electric motor or the like, and it is fixed to a support 25. Although the R-axis is aligned with the Y direction in the first embodiment, the R-axis is not always required to be aligned with the Y direction. Moreover, the R-axis and P-axis are not always required to intersect perpendicularly. In other cases, a positional relation between the R-axis and P-axis may be set, for example, such that the R-axis and P-axis intersect at an angle of 30°, 45°, or 60°.

As illustrated in FIGS. 3 and 4, the R-axis rotation device 22 is disposed substantially at the same height as the top plate 102, and the stage movable space 111 is defined under the opening 103 of the top plate 102. Therefore, when the R-axis rotation device 22 is driven, the stage 21 can be rotated until a lateral side 21*a* or 21*b* of the stage 21 reaches the vicinity of the base plate 22*c* (see FIG. 5). In other words, when the R-axis rotation device 22 is driven, the stage 21 in a horizontal position can be rotated about the R-axis through an angle of not smaller than ±60° (of preferably not smaller than ±75° and more preferably ±) 90°. Here, in order to realize the rotation through ±90° about the R-axis, it is required that, as to the rotation about the R-axis, a height H1 from an upper end of the P-axis rotation device 23 (i.e., the P-axis turning device (P-axis drive source) 23*b*), which is positioned under the lateral side of the stage 21, up to an R rotation axis 22*d* is not shorter than a half of a length L1 of the short side of the stage 21 (see FIG. 5). When the stage 21 is not rectangular, the length L1 is given by a maximum width of the stage 21 in the P-axis direction (i.e., in the direction perpendicular to the R-axis).

In the first embodiment, since the R-axis rotation device 22 is disposed at such a height that it is mostly positioned below the top plate 102, heights of the Y direction drive devices 106*a* and 106*b* can be reduced. As a result, the distance between the nozzle 2 and the stage 21 can be shortened, and accuracy of a landing position of the droplet can be increased.

The R-axis rotation device 22 and the P-axis rotation device 23 are supported by the support 25 that is disposed on the support plate 104 inside the stand 101. Because of the stage movable space 111 being defined above the support plate 104, when the P-axis rotation device 23 is driven, the stage 21 can be rotated until a lateral side 21*c* or 21*d* of the stage 21 reaches the vicinity of the support 25 (see FIG. 6). In other words, when the P-axis rotation device 23 is driven, the stage 21 (or the R-axis rotation device 22) in a horizontal position can be rotated about the P-axis through an angle of not smaller than ±60° (of preferably not smaller than ±75° and more preferably ±90°). Here, in order to realize the rotation through ±90° about the P-axis, it is required that, as to the rotation about the P-axis, a height H2 from an upper end of a member (i.e., the support plate 104), which is positioned under the lateral side of the stage 21, up to a P rotation axis 23*d* is not shorter than a half of a length L2 of the long side of the stage 21 (see FIG. 6). When the stage 21 is not rectangular, the length L2 is given by a maximum width of the stage 21 in the R-axis direction (i.e., in the direction perpendicular to the P-axis).

As illustrated in FIG. 7, the utility unit 24 is installed on the support plate 104. The utility unit 24 includes a nozzle cleaning mechanism, a dumping discharging stage, a clearance adjusting mechanism, and so on. As will be seen from FIG. 1, a clearance necessary for the rotation of the stage 21 by the P-axis rotation device 23 is secured between the utility unit 24 and the stage 21.

FIG. 8 is a side view referenced to explain an application operation performed in a state in which the stage 21 is inclined by the R-axis rotation device 22. With the inclination of the stage 21 by the R-axis rotation device 22, the liquid material can be applied to a first lateral surface of the application target 20.

FIG. 9 is a side view referenced to explain an application operation performed in a state in which the stage 21 is inclined by the P-axis rotation device 23. With the inclination of the stage 21 by the P-axis rotation device 23, the liquid material can be applied to a second lateral surface of the application target 20, the second lateral surface being perpendicular to the first lateral surface.

In the application device 100 according to the first embodiment, since the control device 112 has the function of executing coordinate transformation for the XYZ relatively-moving devices (105, 106 and 107), a θ-axis rotation device for rotating the stage 21 about a θ-axis is no longer required. Because the XY plane is given as a θ rotation plane, θ correction can be performed with a coordination transformation process. As a matter of course, the application method according to the present invention can be implemented even when the θ-axis rotation device for rotating the stage 21 about the θ-axis is installed.

FIG. 10 is an explanatory view referenced to explain locations in the workpiece 20, which is a cover of a smartphone, where the application work is performed. As will be seen from FIG. 10, the workpiece 20 has a size enough to cover the stage 21. When the application work is performed on the cover of the smartphone, an applying and drawing process is performed, starting from (a), in order of (b), (c), (d), (e), (f), (g) and (h), and is ended after returning to (a). As methods of drawing one unbroken line passing the individual points (a) to (h), there are a method of drawing the line by continuously applying the liquid material discharged from the nozzle in a way of causing no break, and a method of forming the line by applying the liquid material in the form of overlapped dots. Either one of those methods can be used in the present invention.

FIG. 11 is an enlarged view referenced to explain an application region 6 in a lateral surface of the cover of the smartphone in FIG. 10. The application region 6 of the cover is a linearly-extending surface inclined outward and downward (like a chamfered surface).

FIG. 12 is an explanatory view referenced to explain procedures of the application work performed on the cover of the smartphone. In FIG. 12, (a) to (h) correspond respectively to (a) to (h) in FIG. 10. In FIG. 12, for the sake of explanation, the nozzle 2 is illustrated in a larger size than usual. Up-, down-, left- and right-directions in (a) to (h) of FIG. 12 described below correspond respectively to up-, down-, left- and right-directions in FIG. 10.

(a) At Start of Application (Lower End of Left Lateral Surface of Workpiece)

The stage 21 is rotated clockwise by the R-axis rotation device 22 such that the application region 6 of the workpiece 20 is positioned to face the nozzle 2. The discharge device 1 is operated to start discharge of the liquid material from an application start position that is set to a lower end of the workpiece on the left side, and the nozzle 2 and the workpiece 20 are moved relative to each other by the set of XYZ relatively-moving devices (105, 106 and 107) (in the Y direction (up-direction in FIG. 10) in this case). The liquid material is thereby applied to the application region 6, i.e., a left lateral surface (first lateral surface) of the workpiece. On that occasion, the R-axis rotation device 22 and the P-axis rotation device 23 are both stopped, and a clearance between the discharge port at the tip end of the nozzle 2 and the workpiece 20 is kept constant.

(b) Upper Left Corner Portion of Workpiece (First Corner Portion)

An upper left corner portion of the workpiece is a rounded corner portion that is continuous with the first lateral surface and the second lateral surface. The stage is rotated forward by the P-axis rotation device 23 while the stage is rotated counterclockwise by the R-axis rotation device 22. The control device 112 synchronizes the rotations of the stage 21 by the R-axis rotation device 22 and the P-axis rotation device 23 with the operations of the XYZ relatively-moving devices that control the position of the nozzle 2, thus enabling the applying and drawing process to be performed along the corner portion of the workpiece 20. Because the corner portion of the workpiece 20 is also inclined outward as illustrated in FIG. 11, the stage 21 is rotated in two directions at the same time by the R-axis rotation device 22 and the P-axis rotation device 23 such that an application target surface is always positioned to face the nozzle. Also in this step, the clearance between the tip end of the nozzle 2 and the workpiece 20 is kept constant as in above (a).

It is also possible to perform the drawing on the corner portion at a drawing speed different from that for a linear portion in above (a). For example, the drawing can be performed at a lower speed along the corner portion than along the linear portion by controlling the rotation speed of the stage 21, the moving speed of the nozzle 2 by the XYZ relatively-moving devices, and the discharge operation (discharge amount) of the discharge device 1. When the drawing is performed at a lower speed along the corner portion, the discharge amount per unit time is reduced.

(c) Upper Linear Portion of Workpiece (Second Lateral Surface)

In a similar manner to that in above (a), the applying and drawing process is performed on the application region 6 in the upper side of the workpiece by moving the nozzle 2 with the set of XYZ relatively-moving devices (in the X direction in this case). At this time, the R-axis rotation device 22 and the P-axis rotation device 23 are both stopped.

(d) Upper Right Corner Portion of Workpiece (Second Corner Portion)

An upper right corner portion of the workpiece is a rounded corner portion that is continuous with the second lateral surface and a third lateral surface. The stage 21 is rotated counterclockwise by the R-axis rotation device 22 while the stage is rotated backward by the P-axis rotation device 23. At this time, as in above (b), the control device 112 synchronizes the rotations of the stage 21 by the R-axis rotation device 22 and the P-axis rotation device 23 with the operations of the XYZ relatively-moving devices that control the position of the nozzle 2.

(e) Right Linear Portion of Workpiece (Third Lateral Surface)

In a similar manner to that in above (a), the applying and drawing process is performed on the application region 6 in the right side of the workpiece by moving the nozzle 2 with the set of XYZ relatively-moving devices (in the Y direction in this case). At this time, the R-axis rotation device 22 and the P-axis rotation device 23 are both stopped.

(f) Lower Right Corner Portion of Workpiece (Third Corner Portion)

A lower right corner portion of the workpiece is a rounded corner portion that is continuous with the third lateral surface and a fourth lateral surface. The stage 21 is rotated clockwise by the R-axis rotation device 22 while the stage 21 is rotated backward by the P-axis rotation device 23. At this time, as in above (b), the control device 112 synchronizes the rotations of the stage 21 by the R-axis rotation device 22 and the P-axis rotation device 23 with the operations of the XYZ relatively-moving devices that control the position of the nozzle 2.

(g) Lower Linear Portion of Workpiece (Fourth Lateral Surface)

In a similar manner to that in above (a), the applying and drawing process is performed on the application region 6 in the lower side of the workpiece by moving the nozzle 2 with the set of XYZ relatively-moving devices (in the X direction in this case). At this time, the R-axis rotation device 22 and the P-axis rotation device 23 are both stopped.

(h) Lower Left Corner Portion of Workpiece (Fourth Corner Portion)

A lower left corner portion of the workpiece is a rounded corner portion that is continuous with the fourth lateral surface and the first lateral surface. The stage 21 is rotated clockwise by the R-axis rotation device 22 while the stage 21 is rotated forward by the P-axis rotation device 23. At this time, as in above (b), the control device 112 synchronizes the rotations of the stage 21 by the R-axis rotation device 22 and the P-axis rotation device 23 with the operations of the XYZ relatively-moving devices that control the position of the nozzle 2.

When the drawing on the lower left corner portion of the workpiece is completed, the R-axis rotation device 22 and the P-axis rotation device 23 come to the same positions as those in above (a). The application work on one workpiece 20 is ended at timing when the drawing is performed until reaching the application start position.

The above-described application device 100 according to the first embodiment can be utilized to perform bonding work for a case (body) of a smartphone and application work for a 3DM ID (3D Model Interconnected Device), for example. Furthermore, the application device 100 can be utilized in applying a protective material to side edges (end surfaces) of two plate-like members when those two members are bonded to each other. According to the present device, even when the liquid material is applied to the above-mentioned peripheral surface, the stage can be rotated such that the peripheral surface is positioned to face the discharge port of the nozzle. Hence a jig or the like for keeping to the workpiece in an erected state during the application is no longer required. In addition, since any of all other portions of the workpiece than that facing the stage becomes the application target, the application can be performed on a lateral peripheral surface of the workpiece as well without changing the posture of the workpiece.

Second Embodiment

As illustrated in FIG. 14, an application device 200 according to a second embodiment is mainly constituted by a discharge device 1 for discharging a liquid material, a stage 21 on an upper surface of which an application target is placed, an R-axis rotation device 22 for rotating the stage 21 about an R-axis, a P-axis rotation device 23 for rotating the stage 21 about a P-axis, a set of XYZ relatively-moving devices (205, 206 and 207) for moving the discharge device 1 and the stage 21 relative to each other, and a control device 112 for controlling operations of the individual devices. Similar components in the second embodiment to those in the first embodiment are denoted by the same reference signs, and description of those components is omitted in some cases.

The discharge device 1 is mounted to a Z direction drive device 207, and the Z direction drive device 207 is mounted to an X direction drive device 205. The stage 21 positioned under the discharge device 1 is mounted to a Y direction drive device 206. Thus the discharge device 1 and the stage 21 can be moved in XYZ directions (108, 109 and 110). Although the image capturing device 11 and the distance measuring device 12 are not mounted to the Z direction drive device 207 in the second embodiment, those devices may be mounted.

The X direction drive device 205 is supported by two posts 202*a* and 202*b* extending upward from a stand 201, and the Y direction drive device 206 is disposed between the two posts 202*a* and 202*b* on an upper surface of the stand 201. A table 221 is mounted to the Y direction drive device 206. The stage 21, the R-axis rotation device 22, and the P-axis rotation device 23, which are similar to those in the first embodiment, are installed on the table 221 with a support 25 interposed therebetween.

Also in the application device 200 according to the second embodiment, by driving the R-axis rotation device 22, the stage 21 in a horizontal position can be rotated about the R-axis through an angle of not smaller than ±60° (of preferably not smaller than ±75° and more preferably ±90°). Furthermore, by driving the P-axis rotation device 23, the stage 21 (or the R-axis rotation device 22) in a horizontal position can be rotated about the P-axis through an angle of not smaller than ±60° (of preferably not smaller than ±75° and more preferably ±) 90°.

The control device 112 for controlling the operations of the XYZ relatively-moving devices (205, 206 and 207), etc. is disposed inside the stand 201. A dispenser controller (discharge control device) 114 for controlling the discharge operation of the discharge device 1 is disposed outside the stand 201 and is electrically connected to the control device 112 and the discharge device 1 via signal cables.

The above-described application device 200 according to the second embodiment can also be utilized to perform bonding work for a case (body) of a smartphone and application work for a 3DM ID (3D Model Interconnected Device), for example, and it can also provide similar working effects to those in the first embodiment.

Third Embodiment

As illustrated in FIGS. 15 and 16, an application device according to a third embodiment includes a second stage 121 disposed on the stage 21. The second stage 121 has a smaller area than the stage 21 and is suitably used when performing the application work on a small workpiece.

The second stage 121 is coupled to the stage 21 through a coupling member 122. The coupling member 122 includes a coupling mechanism coupling the second stage 121 in a detachable manner such that the second stage 121 can be replaced with a third or subsequent stage having a different area from that of the second stage 121. In other words, in the application device according to the third embodiment, one selected from a plurality of stages having different areas can be coupled to the coupling member 122. Like the stage 21, each of the second stage 121 and the third and subsequent stages also includes a fixing mechanism for fixing the workpiece 20.

A lower end portion of the coupling member 122 is detachably coupled to the stage 21 and, by removing the coupling member 122 from the stage 21, the application work can be performed in a state of holding the workpiece 20 by the stage 21.

Other structures of the application device according to the third embodiment are similar to those in the application device 100 according to the first embodiment, and hence description of those structures is omitted.

With the above-described application device according to the third embodiment, even when there are various types of workpieces 20, the discharge device 1 can be avoided from interfering with the stage 21 during the application work by holding each workpiece 20 on a stage with a smaller area than the relevant workpiece 20.

The application device according to the third embodiment can also be utilized to perform bonding work for a case (body) of a smartphone and application work for a 3DM ID (3D Model Interconnected Device), for example, and it can also develop similar working effects to those in the first embodiment.

LIST OF REFERENCE SIGNS

1: discharge device
2: nozzle
3: liquid storage container
4: discharge head
5: droplet
6: application region
10: base plate
11: image capturing device
12: distance measuring device
13: discharge unit

14: discharge driver
15: discharge port
16: plunger
20: application target (workpiece)
21: stage
22: R-axis rotation device
23: P-axis rotation device
24: utility unit
25: support
100: application device (first embodiment)
101: stand
102: top plate
103: opening
104: support plate
105: X direction drive device (X direction moving device)
106: Y direction drive device (Y direction moving device)
107: Z direction drive device (Z direction moving device)
108: X moving direction
109: Y moving direction
110: Z moving direction
111: stage movable space
112: control device
113: input/output device
114: dispenser controller (discharge control device)
121: second stage
122: support member
200: application device (second embodiment)
201: stand
202: post
205: X direction drive device (X direction moving device)
206: Y direction drive device (Y direction moving device)
207: Z direction drive device (Z direction moving device)
221: table

The invention claimed is:

1. An application device comprising:

a discharge head that includes a discharge device having a discharge port opened in a Z direction;

a stage that holds a workpiece;

a set of XYZ relatively-moving devices that moves the discharge head and the stage relative to each other;

an R-axis rotation device that rotates the stage about an R-axis parallel to an XY plane;

a P-axis rotation device that rotates the stage about a P-axis parallel to the XY plane, the P-axis extending in a different direction from the R-axis;

a control device; and a stand, wherein the P-axis rotation device is disposed under the R-axis rotation device, and the P-axis rotation device rotates the stage and the R-axis rotation device together.

2. The application device according to claim 1, wherein the R-axis rotation device is able to rotate the stage through an angle of not smaller than ±60°, and the P-axis rotation device is able to rotate the stage through an angle of not smaller than ±60°.

3. The application device according to claim 2, wherein the R-axis rotation device is able to rotate the stage through an angle of ±90°, and the P-axis rotation device is able to rotate the stage through an angle of ±90°.

4. The application device according to claim 1, wherein a maximum width L1 of the stage in a direction perpendicular to the R-axis is shorter than a maximum width L2 of the stage in a direction perpendicular to the P-axis.

5. The application device according to claim 1, wherein a height H1 from an upper end of a member, the member positioned under a lateral side of the stage when the R-axis rotation device is operated, to the R-rotation axis is set to a distance that is not shorter than a half of the maximum width L1, and a height H2 from an upper end of a member, the member positioned under a lateral side of the stage when the P-axis rotation device is operated, to the P-rotation axis is set to a distance that is not shorter than a half of the maximum width L2.

6. The application device according to claim 1, wherein the application device does not include a rotation mechanism that rotates the stage in a θ direction.

7. The application device according to claim 1, wherein the stand includes a top plate having an opening that is formed to extend over a movable region of the stage, and a stage movable space in which the stage is allowed to rotate about the R-axis and the P-axis.

8. The application device according to claim 7, wherein the set of XYZ relatively-moving devices is disposed on the top plate.

9. The application device according to claim 1, wherein the set of XYZ relatively-moving devices is constituted by two first-direction moving devices that are disposed with the stage interposed therebetween, a second-direction moving device that is mounted in a bridging relation to the two first-direction moving devices, and a third-direction moving device that is mounted to the second-direction moving device.

10. The application device according to claim 1, further comprising a plurality of posts extending upward from the stand; and a table installed on the stand, wherein the R-axis rotation device and the P-axis rotation device are installed on the table, and the set of XYZ relatively-moving devices is constituted by a first-direction moving device that moves the table in a first direction, a second-direction moving device that is supported by the plurality of posts, and a third-direction moving device that is mounted to the second-direction moving device.

11. The application device according to claim 9, wherein the discharge head is mounted to the third-direction moving device and does not include a rotation mechanism rotating the discharge device.

12. The application device according to claim 10, wherein the discharge head is mounted to the third-direction moving device and does not include a rotation mechanism rotating the discharge device.

13. The application device according to claim 1, wherein the stage is prepared as a plurality of stages having different areas, and application work is performed by using one selected from the plurality of stages and holding a workpiece on the selected one stage.

14. The application device according to claim 1, wherein the discharge device is a discharge device of jet type moving a valve member forward, stopping the valve member to apply inertial force to a liquid material, and discharging the liquid material in a flying form.

15. The application device according to claim 1, wherein the set of XYZ relatively-moving devices is constituted by an X direction moving device that moves the discharge head and the stage relative to each other along a linear line in an X direction, a Y direction moving device that moves the discharge head and the stage relative to each other along a linear line in a Y direction, and a Z direction moving device that moves the discharge head and the stage relative to each other along a linear line in a Z direction, and when a linear or curved application line is formed, the control device moves at least one of the X direction moving device and the Y direction moving device such that the discharge head continuously performs relatively-moving operation.

16. An application method of performing application on a workpiece placed on a stage with the application device according to claim 1.

17. An application method of performing application on a workpiece placed on a stage with the application device according to claim 1, the application method comprising:

a first-lateral-surface application step of performing the application on a first lateral surface of the workpiece in a state in which, after rotating the stage by the R-axis rotation device, the R-axis rotation device and the P-axis rotation device are both stopped and a clearance between the discharge device and the workpiece is kept constant; and a second-lateral-surface application step of performing the application on a second lateral surface of the workpiece, the second lateral surface intersecting the first lateral surface, in a state in which, after rotating the stage by the P-axis rotation device, the R-axis rotation device and the P-axis rotation device are both stopped and the clearance between the discharge device and the workpiece is kept constant, wherein the second-lateral-surface application step is performed after performing the first-lateral-surface application step, or the first-lateral-surface application step is performed after performing the second-lateral-surface application step.

18. The application method according to claim 17, further comprising a corner application step performed after performing the first-lateral-surface application step and before performing the second-lateral-surface application step, or after performing the second-lateral-surface application step and before performing the first-lateral-surface application step, wherein, in the corner application step, the application is performed on a rounded corner portion, which is continuous with the first lateral surface or the second lateral surface of the workpiece, by continuously operating the R-axis rotation device and the P-axis rotation device while the clearance between the discharge device and the workpiece is kept constant.

19. The application method according to claim 16, wherein the workpiece has a size enough to cover the stage.

20. The application method according to claim 17, wherein the workpiece has a size enough to cover the stage.

* * * * *